US010107145B2

(12) United States Patent
Yano et al.

(10) Patent No.: US 10,107,145 B2
(45) Date of Patent: Oct. 23, 2018

(54) ADJUSTABLE VALVE DEVICE OF INTERNAL COMBUSTION ENGINE

(71) Applicant: TOYOTA JIDOSHA KABUSHIKI KAISHA, Toyota-shi, Aichi-ken (JP)

(72) Inventors: Toshiyuki Yano, Gotemba (JP); Yoshiaki Miyazato, Shizuoka-ken (JP); Hidetoshi Hirose, Susono (JP); Yoshikazu Hara, Atsugi (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 139 days.

(21) Appl. No.: 15/030,417

(22) PCT Filed: Jan. 22, 2015

(86) PCT No.: PCT/JP2015/051697
§ 371 (c)(1),
(2) Date: Apr. 19, 2016

(87) PCT Pub. No.: WO2015/111661
PCT Pub. Date: Jul. 30, 2015

(65) Prior Publication Data

US 2016/0319705 A1 Nov. 3, 2016

(30) Foreign Application Priority Data

Jan. 22, 2014 (JP) ..... 2014-009802

(51) Int. Cl.
*F01L 1/34* (2006.01)
*F01L 1/08* (2006.01)
(Continued)

(52) U.S. Cl.
CPC *F01L 1/08* (2013.01); *F01L 1/04* (2013.01); *F01L 1/267* (2013.01); *F01L 13/0036* (2013.01); *F01L 2001/0473* (2013.01)

(58) Field of Classification Search
CPC ..... F01L 1/04; F01L 1/08; F01L 1/267; F01L 13/0036; F01L 2001/0473
(Continued)

(56) References Cited

U.S. PATENT DOCUMENTS 6,427,653 B1 8/2002 Hara et al.
7,069,889 B2 7/2006 Lechner et al.
(Continued)

FOREIGN PATENT DOCUMENTS

DE 10038916 A1 2/2002
GB 2427897 A 1/2007
(Continued)

OTHER PUBLICATIONS

English translation of the Written Opinion of the International Searching Authority dated Oct. 23, 2012, in International Application No. PCT/JP2012/071186.
(Continued)

*Primary Examiner* — Ching Chang
(74) *Attorney, Agent, or Firm* — Hunton Andrews Kurth LLP

(57) ABSTRACT

An adjustable valve device includes: a first cam portion penetrated by a camshaft, rotating with the camshaft, and including an elongated hole formed therein; a U or L shaped second cam portion supported by the first cam portion so as to swing to move between a first state and a second state; a stopper pin fixed to the second cam portion and penetrating through the elongated hole; a biasing member biasing the stopper pin so that the second cam portion becomes in the first state; a lock mechanism locking the second cam portion only when the second cam portion is in the first state; and a cam follower exerting a reactive force so that the second cam portion becomes in the second state in a state where a lock of the second cam portion is released, wherein the reactive force is greater than a biasing force of the biasing member.

6 Claims, 15 Drawing Sheets

(51) Int. Cl.

| | |
|---|---|
| ***F01L 1/04*** | (2006.01) |
| ***F01L 1/26*** | (2006.01) |
| ***F01L 13/00*** | (2006.01) |
| *F01L 1/047* | (2006.01) |

(58) Field of Classification Search
USPC ..... 123/90.16, 90.39, 90.44, 90.6
See application file for complete search history.

(56) References Cited

U.S. PATENT DOCUMENTS

| | | | | |
|---|---|---|---|---|
| 9,745,875 | B2 * | 8/2017 | Yano ..... | F01L 13/0057 |
| 2006/0011161 | A1 | 1/2006 | Lechner et al. | |
| 2015/0184560 | A1 | 7/2015 | Yano et al. | |

FOREIGN PATENT DOCUMENTS

| | | | |
|---|---|---|---|
| JP | S60-8402 | U | 1/1985 |
| JP | S62-195608 | U | 12/1987 |
| JP | 2001-329819 | A | 11/2001 |
| JP | 2006-526727 | A | 11/2006 |
| WO | 2004109068 | A1 | 12/2004 |

OTHER PUBLICATIONS

US Patent and Trademark Office, Notice of Allowability in U.S. Appl. No. 14/422,501, dated Apr. 18, 2017, 1 page.
US Patent and Trademark Office, Office Action in U.S. Appl. No. 14/422,501, dated Nov. 16, 2016 2 pages.

* cited by examiner

ADJUSTABLE VALVE DEVICE OF INTERNAL COMBUSTION ENGINE

CROSS-REFERENCE TO RELATED APPLICATIONS

This is a national phase application based on the PCT International Patent Application No. PCT/JP2015/051697 filed Jan. 22, 2015, claiming priority to Japanese Patent Application No. 2014-009802 filed Jan. 22, 2014, the entire contents of both of which are incorporated herein by reference.

TECHNICAL FIELD

The present invention relates to an adjustable valve device of an internal combustion engine.

BACKGROUND ART

In a device disclosed in Patent Document 1, a camshaft penetrates through an elongated hole formed in a movable cam. This allows the movable cam to eccentrically rotate in relation to the camshaft, and to reciprocate in a radial direction by a reactive force received from a valve in response to the rotation of the camshaft. A plunger that is biased by a spring and extends by the effect of hydraulic pressure is located between the camshaft and the movable cam. When the hydraulic pressure is not exerted, the plunger extends and contracts, and the movable cam is allowed to reciprocate in the radial direction with respect to the camshaft. When the hydraulic pressure is exerted, the plunger is maintained at the extended state, and the position of the movable cam relative to the camshaft is fixed.

PRIOR ART DOCUMENT

Patent Document

[Patent Document 1] Japanese Patent Application Publication No. 2001-329819

SUMMARY OF THE INVENTION

Problems to be Solved by the Invention

In the device of Patent Document 1, since the camshaft penetrates through the elongated hole of the movable cam, it may be considered to employ a thin camshaft to secure the movable range of the movable cam. However, the thin camshaft may reduce the rigidity.

Therefore, the present invention aims to provide an adjustable valve device of an internal combustion engine that prevents reduction of the rigidity of a camshaft.

Means for Solving the Problems

The aforementioned objective is achieved by an adjustable valve device of an internal combustion engine including: a first cam portion that is penetrated by a camshaft, rotates together with the camshaft, and includes an elongated hole formed therein; a second cam portion that is formed into approximately U-shape or approximately L-shape, and is supported by the first cam portion so as to swing to move between a first state where the second cam portion is located at a position where the second cam portion protrudes from an outer peripheral surface of the first cam portion and a second state where the second cam portion is located at a position lower than a position in the first state; a stopper pin that is fixed to the second cam portion and penetrates through the elongated hole; a biasing member that intervenes between the first cam portion and the second cam portion, and biases the stopper pin so that the second cam portion is in the first state; a lock mechanism that locks the second cam portion only when the second cam portion is in the first state; and a cam follower that exerts a reactive force on the second cam portion so that the second cam portion is in the second state in a state where a lock of the second cam portion is released, wherein the reactive force is greater than a biasing force of the biasing member.

The lock mechanism may be configured to include: a first engagement hole that is formed in the first cam portion; a second engagement hole that is formed in the second cam portion, and faces the first engagement hole in the first state; a pressing member that is accommodated in the first engagement hole; a lock member that is accommodated in the second engagement hole; a lock member biasing member that biases the lock member so that the lock member engages with the first and second engagement holes in the first state; and a passage that communicates with the first engagement hole, and exerts hydraulic pressure on the pressing member so that the lock member is disconnected from the first engagement hole against a biasing force of the lock member biasing member in the first state.

The first and second engagement holes may be configured to extend in an axial direction of the camshaft.

The second cam portion may be configured to include: a first inclined surface that protrudes from an outer peripheral surface of the first cam portion in the first state; and a second inclined surface that partially coincides with the outer peripheral surface of the first cam portion as viewed from an axial direction of the camshaft in both the first and second states.

The second cam portion may be configured to move from the second state to the first state while the first and second cam portions contact with the cam follower in accordance with rotation of the camshaft in the state where the lock of the second cam portion is released.

The second cam portion may be configured to include: an inclined surface located at a valve opening side of the second cam portion; and an inclined surface located at a valve closing side of the second cam portion, and a fulcrum point of swing of the second cam portion may be located at a side of the inclined surface located at the valve closing side of the second cam portion.

Effects of the Invention

An adjustable valve device of an internal combustion engine that prevents reduction of the rigidity of a camshaft can be provided.

MODES FOR CARRYING OUT THE INVENTION

Hereinafter, a description will be given of details of an embodiment with reference to drawings.

Figure 1:
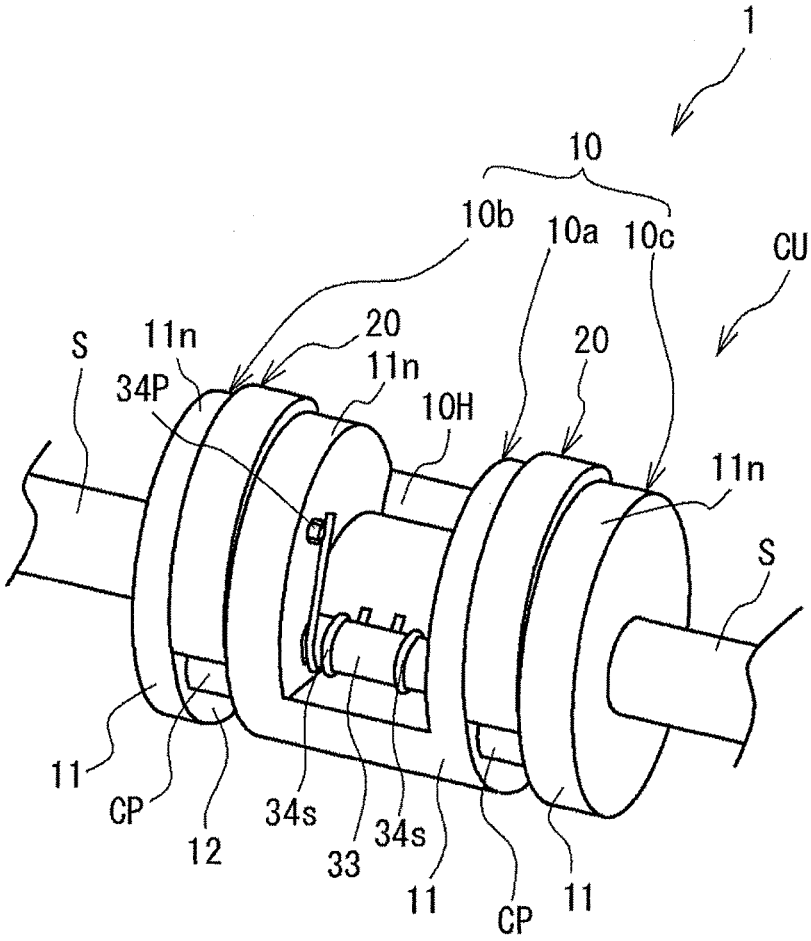
FIG. 1 is an external view of an adjustable valve device of a present embodiment.

FIG. 1 is an external view of an adjustable valve device 1 of a present embodiment. The adjustable valve device 1 is employed in an internal combustion engine mounted on a vehicle or the like. The adjustable valve device 1 includes a camshaft S, and a cam unit CU arranged on the camshaft S. The camshaft S rotates by the power from the internal combustion engine. The rotation of the cam unit CU together with the camshaft S lifts a valve V via a rocker arm R described later. The valve V is an intake valve or an exhaust valve for an internal combustion engine.

The cam unit CU includes a cam base portion 10 that has a diameter larger than that of the camshaft S and is penetrated by the camshaft S, and two cam lobe portions 20 supported by the cam base portion 10. The cam base portion 10 has a substantially cylindrical shape, and has base circular portions 11 each having a semi-cylindrical shape when viewed from the axial direction of the camshaft S (hereinafter, referred to as the axial direction), and nose portions 11*n* each protruding outward from the base circular portion 11 in the radial direction. The base circular portion 11 and the nose portion 11*n* correspond to the outer peripheral surface of the cam base portion 10. The cam base portion 10 includes a cam piece portion 10*a*, and two cam piece portions 10*b* and 10*c* that are coupled so as to sandwich the cam piece portion 10*a*. The cam piece portions 10*a* through 10*c* are coupled by two coupling pins CP each penetrating through the cam piece portions 10*a* through 10*c*. The cam piece portions 10*a* through 10*c* have the same outer peripheral shape when viewed from the axial direction. That is to say, each of the cam piece portions includes the base circular portion and the nose portion formed therein. The cam piece portions 10*a* through 10*c* are aligned in the axial direction.

The cam piece portions 10*a* and 10*b* are coupled across a space 12, and the cam lobe portion 20 is arranged in the space 12. In the same manner, the other cam lobe portion 20 is arranged in the space 12 between the cam piece portions 10*a* and 10*c*. The two cam lobe portions 20 are aligned at a predetermined interval in the axial direction, and each of them can presses the corresponding one of two rocker arms R to lift the corresponding one of two valves V. The entire thickness of the cam base portion 10 in the axial direction is thicker than the thickness of the cam lobe portion 20 in the axial direction.

As illustrated in FIG. 1, a recess portion 10H is formed in the cam piece portion 10*a* of the cam base portion 10. The recess portion 10H is formed between portions at which the two rocker arms R contact with the cam base portion 10, and makes no contact with the two rocker arms R. A support shaft 33 penetrates through the cam piece portions 10*a* through 10*c* and the cam lobe portion 20 in the axial direction. The cam lobe portion 20 swings around the support shaft 33 as a fulcrum point in relation to the cam base portion 10. The support shaft 33 is a fulcrum point of the swing of the cam lobe portion 20. The cam lobe portion 20 can swing between a high position at which the cam lobe portion 20 protrudes from the cam base portion 10 and a low position at which the cam lobe portion 20 does not protrude from the cam base portion 10. A state where the cam lobe portion 20 protrudes from the cam base portion 10 at a maximum corresponds to a first state. A state where the cam lobe portion 20 does not protrude from the cam base portion 10 corresponds to a second state. The end portion of the support shaft 33 is exposed in the recess portion 10H. A stopper pin 34P penetrates to and is fixed to the cam lobe portion 20 arranged at the cam piece portion 10*b* side, and the same applies to the cam lobe portion 20 arranged at the cam piece portion 10*c* side.

In the recess portion 10H, a part of the support shaft 33 is exposed, and two springs 34*s* are wound around the exposed part. A first spring 34*s* is arranged at the cam piece portion 10*b* side, and a second spring 34*s* is arranged at the cam piece portion 10*c* side. A first end of the first spring 34*s* presses the inner surface of the recess portion 10H, and a second end thereof presses the stopper pin 34P of the cam lobe portion 20 arranged at the cam piece portion 10*b* side. More specifically, the spring 34*s* biases the stopper pin 34P so that the stopper pin 34P separates from the recess portion 10H. Accordingly, the cam lobe portion 20 at the cam piece portion 10*b* side is biased so as to protrude from the cam base portion 10. The same applies to the cam lobe portion 20 at the cam piece portion 10*c* side. As described above, the spring 34*s* intervenes between the cam base portion 10 and the cam lobe portion 20, and biases the cam lobe portion 20 toward the high position. The spring 34*s* is an example of a biasing member.

In the case of the present embodiment, when the cam lobe portion 20 is locked at the high position, the cam lobe portion 20 drives the rocker arm R to lift the valve V. When the lock is released, the valve V is lifted by the cam base portion 10 practically while the cam lobe portion 20 receives a reactive force from the rocker arm R and swings in relation to the cam base portion 10. The details will be described later. The cam base portion 10 is an example of a first cam portion, and the cam lobe portion 20 is an example of a second cam portion. In FIG. 1, the cam lobe portion 20 is at the high position. A state where the cam lobe portion 20 is locked will be referred to as a locked state, and a state where the lock of the cam lobe portion 20 is released will be referred to as a released state.

Figure 2A:
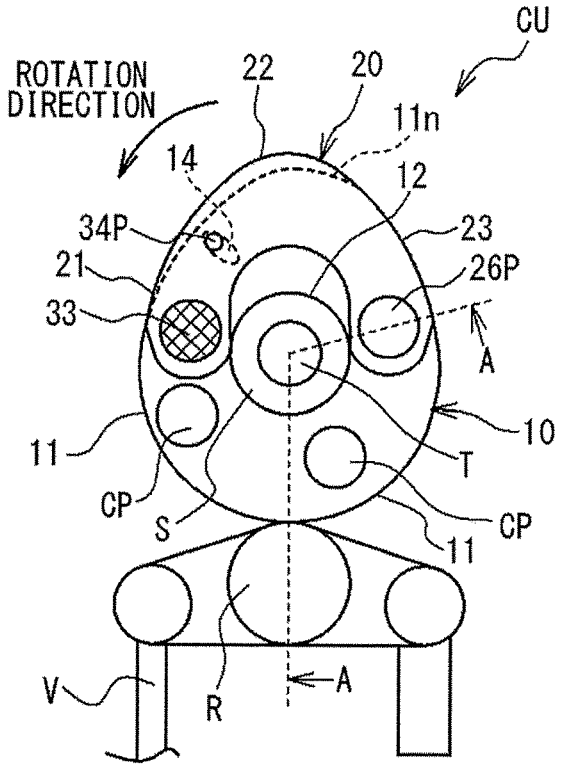
FIGS. 2A and 2B are cross-sectional views of a cam unit viewed from an axial direction.
Figure 2B:
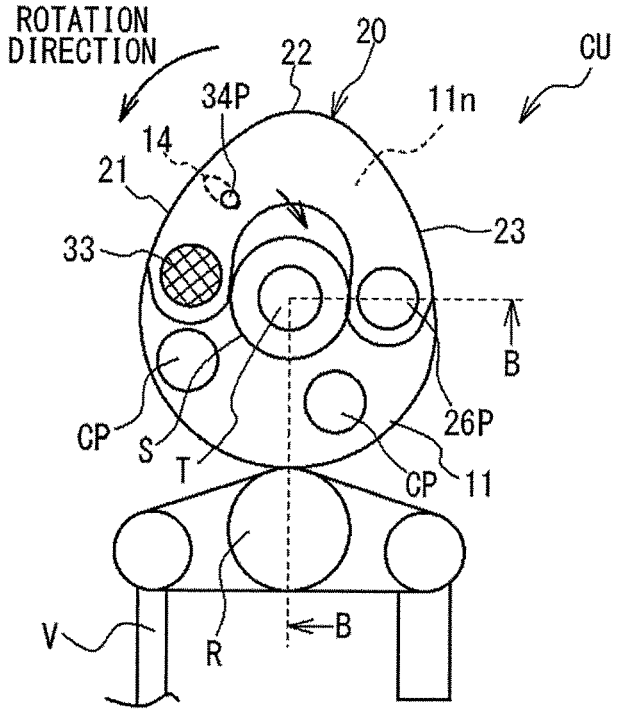

FIGS. 2A and 2B are cross-sectional views of the cam unit CU viewed from the axial direction. FIG. 2A illustrates the cam lobe portion 20 at the high position, and FIG. 2B illustrates the cam lobe portion 20 at the low position. A passage T of which the specifics will be described later is formed in the camshaft S.

The cam lobe portion 20 is substantially U-shaped or substantially L shaped so as to bypass the camshaft S. The support shaft 33 penetrates through a first end of the cam lobe portion 20. In FIGS. 2A and 2B, the camshaft S rotates counterclockwise. Accordingly, the cam base portion 10 and the cam lobe portion 20 also rotate counterclockwise. An elongated hole 14 penetrated by the stopper pin 34P is formed in the cam piece portion 10*a*. The elongated hole 14 regulates the moving range of the stopper pin 34P that moves in accordance with the swing of the cam lobe portion 20 to regulate the swing range of the cam lobe portion 20. The same applies to the cam piece portion 10*b*.

The outer peripheral surface of the cam lobe portion 20 that makes contact with the roller of the rocker arm R includes an inclined surface 21, a top surface 22, and an inclined surface 23 continuously formed in this order in a direction opposite to the rotation direction of the camshaft S. The inclined surfaces 21 and 23 are examples of first and second inclined surfaces facing each other across the top surface 22, respectively. The inclined surface 21, the top surface 22, and the inclined surface 23 come in contact with the roller of the rocker arm R in this order. When the cam lobe portion 20 is at the high position, the top surface 22 is at a position farthest from the rotational center of the cam unit CU, and the inclined surface 21 and the top surface 22 are located further out than the nose portion 11*n* of the cam base portion 10, protruding from the outer peripheral surface of the cam base portion 10. The support shaft 33 is located on the leading side of the cam lobe portion 20 relative to the rotational direction of the camshaft S, and is located at the inclined surface 21 side. The support shaft 33 is located at a position located away from the rotational center of the cam base portion 10, that is, the rotational center of the camshaft S. A pin 26P is located on the trailing side of the cam lobe portion 20 relative to the rotational direction of the camshaft S, and is located at the inclined surface 23 side. The details will be described later.

Figure 3A:
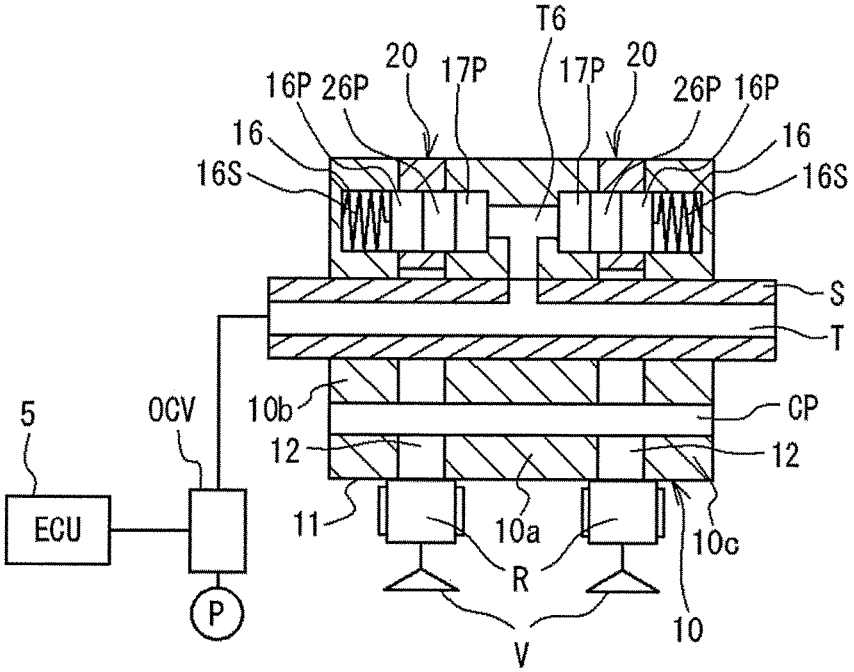
FIGS. 3A and 3B are cross-sectional views illustrating an internal structure of the cam unit.
Figure 3B:
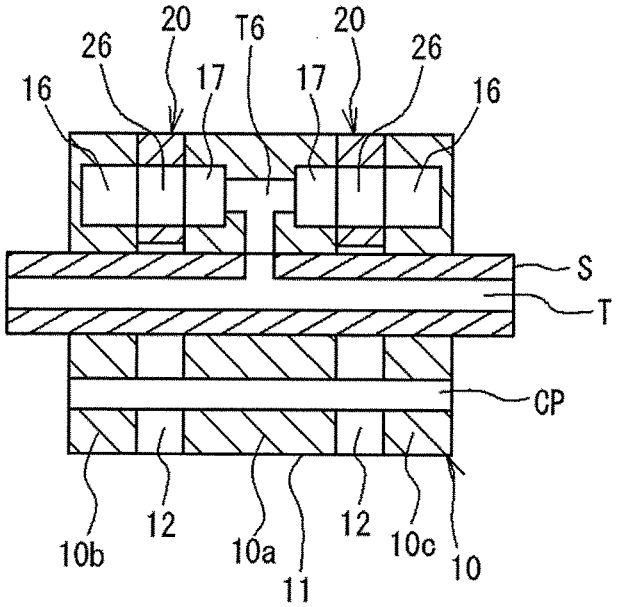

FIGS. 3A and 3B are cross-sectional views illustrating an internal structure of the cam unit CU. In FIGS. 3A and 3B, both the two cam lobe portions 20 are at the high position. FIGS. 3A and 3B correspond to cross-sectional views taken along line A-A in FIG. 2A. As illustrated in FIGS. 3A and 3B, the cam unit CU is symmetrically formed. Thus, the description hereinafter explains the cam lobe portion 20 at the cam piece portion 10*b* side. A passage T6 continuously extending outward in the radial direction from the passage T is formed in the cam piece portion 10*a*. The passage T6 extends outward from the passage T in the radial direction, then extends in the axial direction, and extends toward the two cam lobe portions 20. The passage T6 is an example a passage portion that supplies hydraulic pressure.

An oil control valve OCV is a flow rate control valve of an electromagnetic drive type, and is controlled by an ECU 5. The ECU 5 is an example of a control unit. Oil reserved in an oil pan is supplied into the passage T by an oil pump P. The oil pump P is a mechanical pump coupled to the crankshaft of the internal combustion engine. The oil control valve OCV can linearly adjust the hydraulic pressure supplied into the passage T by the oil pump P based on a value of electric current applied to the oil control valve OCV. The oil control valve OCV is an example of a hydraulic pressure control valve. The hydraulic pressure control valve may be a valve capable of adjusting the hydraulic pressure supplied into the passage T in a step-by-step manner. The ECU 5 includes a CPU, a ROM, a RAM, and the like, and controls the entire operation of the internal combustion engine. The ROM stores programs for executing the control described later.

The cam piece portion 10*b* holds a pin 16P, and the cam piece portion 10*a* holds a pin 17P. The cam lobe portion 20 holds the pin 26P. The pin 26P is an example of a lock member. The pin 17P is an example of a pressing member. FIG. 3B is a diagram that omits the illustration of the pin 16P and the like. The cam lobe portion 20 has a second end portion that is located away from the first end portion penetrated by the support shaft 33, and a hole 26 holding the pin 26P is formed in the second end portion of the cam lobe portion 20. The hole 26 penetrates through the cam lobe portion 20 in the axial direction. A hole 17 is an example of a first engagement hole. The hole 26 is an example of a second engagement hole.

A hole 16 communicating with the space 12 is formed in the cam piece portion 10*b* of the cam base portion 10. The hole 16 extends in the axial direction, and has a bottom surface. The pin 16P is accommodated in the hole 16. A spring 16S coupled to the pin 16P is arranged between the bottom surface of the hole 16 and the pin 16P. The spring 16S biases the pin 16P toward the cam lobe portion 20. The spring 16S is an example of a lock member biasing member.

The hole 17 facing the hole 16 across the space 12 is formed in the cam piece portion 10*a* of the cam base portion 10. The pin 17P is accommodated in the hole 17. The hole 17 communicates with the passage T6. When the cam lobe portion 20 is at the high position, the hole 17 is positioned coaxially with the hole 16, and faces the hole 16. The hole 17 extends in the axial direction.

When the cam lobe portion 20 is at the high position, the holes 16, 17, and 26 are aligned in the axial direction, and the pins 16P, 17P, and 26P are aligned in the axial direction. In other words, the swing range of the cam lobe portion 20 is defined by the stopper pin 34P and the elongated hole 14 so that the cam lobe portion 20 is positioned at the aforementioned position at one end of the swing range. The biasing force of the spring 16S inserts the pin 16P commonly into the holes 16 and 26, and inserts the pin 26P commonly into the holes 26 and 17. This allows the cam lobe portion 20 to be locked at the high position by the cam base portion 10.

Figure 4A:
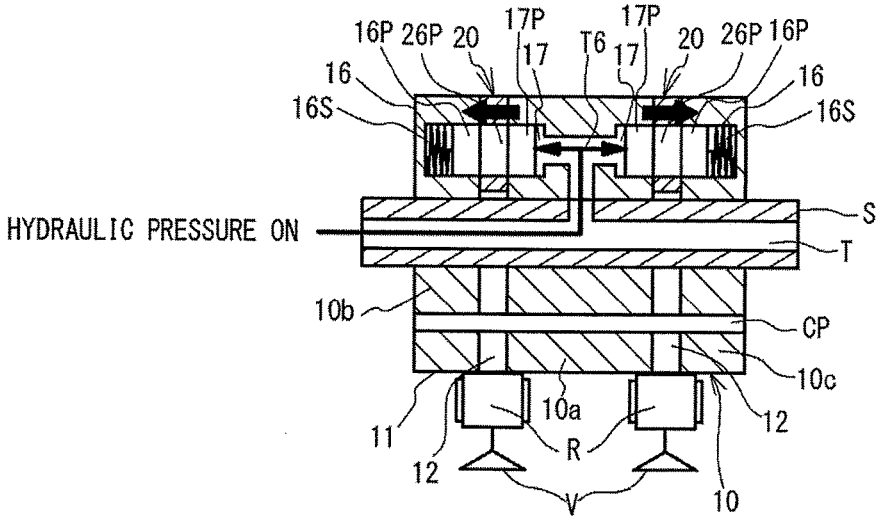
FIGS. 4A and 4B are explanatory diagrams of a lock of a cam lobe portion.
Figure 4B:
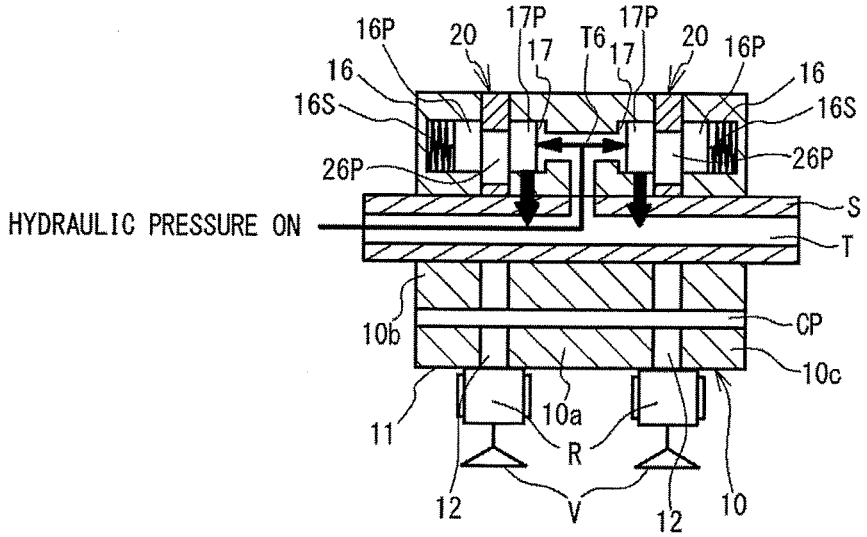

The description will next be given of the lock of the cam lobe portion 20. FIGS. 4A and 4B are explanatory diagrams of the lock of the cam lobe portion 20. When oil is supplied into the passage T6 through the passage T by the oil control valve OCV and the oil pump P, the pin 17P is pressed against the biasing force of the spring 16S and toward the cam lobe portion 20 as illustrated in FIG. 4A. This allows the pin 16P to be disconnected from the hole 26, and allows the pin 26P to be disconnected from the hole 17. That is to say, the pins 16P, 17P, and 26P are accommodated in the holes 16, 17, and 26, respectively. This releases the lock of the cam lobe portion 20 at the high position.

When the camshaft S rotates in the released state, the cam lobe portion 20 receives a reactive force from the rocker arm R, and the cam lobe portion 20 moves against the biasing force of the spring 34*s* and toward the low position as illustrated in FIG. 4B. In other words, the biasing force of the spring 34*s* is designed so as to allow the cam lobe portion 20 to move to the low position only by the reactive force from the rocker arm R in the released state. As described above, the rocker arm R presses the cam lobe portion 20 toward the low position in the released state. The rocker arm R is an example of a cam follower for driving a valve. The cam follower may be a valve lifter directly driven by the cam. FIG. 4B corresponds to a cross-sectional view taken along line B-B in FIG. 2B.

Although the details will be described later, the cam lobe portion 20 recovers from the low position to the high position while making contact with the rocker arm R in accordance with the rotation of the camshaft S, and separates from the rocker arm R. Thus, the cam lobe portion 20 contacts with and separates from the rocker arm R repeatedly in accordance with the rotation of the camshaft S, and swings between the low position and the high position by the reactive force from the rocker arm R and the biasing force of the spring 34*s*. As described above, in the released state, while the cam lobe portion 20 swings so as to follow the rocker arm R, the nose portion 11*n* of the cam base portion 10 presses the rocker arm R to lift the valve V.

When the oil control valve OCV stops supplying oil to the passage T, the pin 16P is commonly inserted into the holes 16 and 26 by the biasing force of the spring 16S, and the pin 26P is commonly inserted into the holes 26 and 17 in the same manner as illustrated in FIG. 3A in a state where the cam lobe portion 20 is at the high position. This allows the cam lobe portion 20 to be locked again at the high position. The cam lobe portion 20 is locked at the high position as described above. The hole 26, the pins 26P and 17P, the spring 16S, and the hole 17 are examples of a lock mechanism that locks the cam lobe portion 20 in the first state.

As illustrated in FIGS. 2A through 3B, the cam lobe portion 20 is not penetrated by the camshaft S, and is located outside the camshaft S. Thus, to expand, for example, the swing range of the cam lobe portion 20, the high position of the cam lobe portion 20 needs to be changed to a further higher position. More specifically, the cam lobe portion 20 can be locked at a position further higher than the high position indicated in the present embodiment by expanding the elongated hole 14 that regulates the moving range of the stopper pin 34P and changing the positions of the holes 17 and 16. As described above, the camshaft S is not required to be changed to secure the swing range of the cam lobe portion 20.

For example, in a structure where an elongated hole is formed in a cam lobe portion, and a camshaft penetrates through the elongated hole, it may be considered to employ a thin camshaft to secure the swing range of the cam lobe portion. The thin camshaft may reduce the rigidity. The present embodiment can secure the swing range of the cam lobe portion 20 without employing a thin camshaft, and can prevent the reduction of the rigidity of the camshaft.

In a structure where an elongated hole is formed in a cam lobe portion, and a camshaft penetrates through the elongated hole, it may be considered to employ a cam lobe portion in which the elongated hole is expanded to secure the swing range of the cam lobe portion. When the cam lobe portion has the large elongated hole, the rigidity may be reduced because the thickness decreases and the cross-sectional area in the axial direction becomes insufficient. The present embodiment secures the thickness of the cam lobe portion 20, i.e., the cross-sectional area in the axial direction while securing the swing range of the cam lobe portion 20 because the camshaft S does not penetrate through the cam lobe portion 20, thereby preventing the reduction of the rigidity.

As illustrated in FIG. 1, the spring 34*s* provides bias between the cam base portion 10 and the cam lobe portion 20 through the stopper pin 34P, and is supported by the support shaft 33 at a position at which the spring 34*s* makes no contact with the camshaft S. Thus, a biasing member that biases the cam lobe portion 20 toward the high position is not required to be located between the camshaft S and the cam lobe portion 20. Accordingly, the provision of the structure for holding the biasing member to the camshaft S becomes unnecessary, the structure is prevented from being complicated, and the reduction of the rigidity can be prevented.

All the holes 16 and 17 formed in the cam base portion 10 and accommodating the pins 16P and 17P, and the hole 26 formed in the cam lobe portion 20 extend in the axial direction. Thus, the cross-sectional area of the cam base portion 10 in the axial direction can be secured, compared to, for example, a case where a hole extending in a direction intersecting the axial direction is formed, and a pin sliding in the hole is arranged. Accordingly, the reduction of the rigidity of the cam unit CU is prevented.

As illustrated in FIGS. 1 and 3A, the springs 16S and 34*s* are arranged in the axial direction with respect to the cam lobe portion 20. The cross-sectional area of the cam lobe portion 20 in the axial direction can be thus secured compared to, for example, a case where the aforementioned spring 34*s* is arranged in a position overlapping the radial direction with respect to the cam lobe portion 20. This prevents the reduction of the rigidity of the cam lobe portion 20.

Additionally, as described above, the recess portion 10H in which the spring 34*s* is arranged is located in a portion that makes no contact with the rocker arm R, and thus this portion is effectively used. Since the spring 34*s* is arranged in a position distant from a portion of the cam base portion 10 contacting with the rocker arm R, the cross-sectional area of the portion of the cam base portion 10 contacting with the rocker arm R in the axial direction is also secured. Accordingly, the reduction of the rigidity of the cam base portion 10 is prevented.

In addition, the lock mechanism of the present embodiment locks the cam lobe portion 20 only at the high position. For example, if a mechanism that locks the cam lobe portion 20 both at the high position and at the low position is provided in the cam base portion 10, the structure of the cam base portion 10 becomes complicated, and the rigidity may be reduced. The present embodiment locks the cam lobe portion 20 only at the high position, and thus simplifies the structure of the cam base portion 10 and prevents the reduction of the rigidity. In addition, the production cost is also reduced because the structure is simplified.

If the swing range of the cam lobe portion 20 is desired to be small when a mechanism that locks the cam lobe portion 20 at the high position and a mechanism that locks the cam lobe portion 20 at the low position are provided in the cam base portion 10, the two lock mechanisms need to be located close to each other. However, to secure the strength of the cam base portion 10 or the like, the two lock mechanism needs to be located away from each other to some extent, and there is a limitation in setting the swing range small. The present embodiment locks the cam lobe portion 20 only at the high position, and thus is not subject to the limitation and can set the swing range small.

Figure 5:
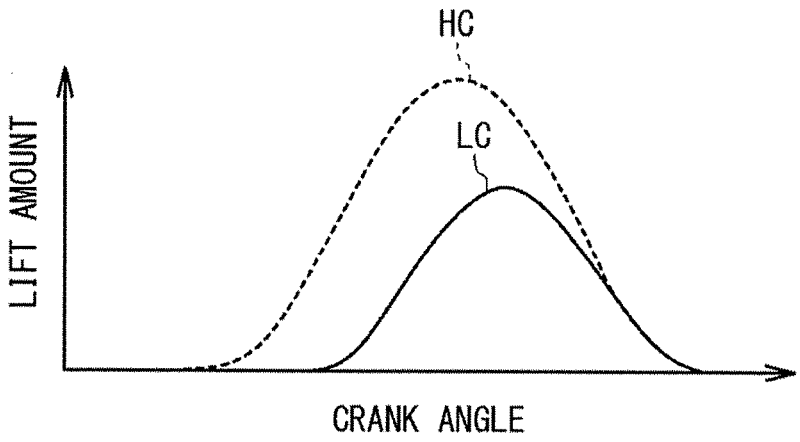
FIG. 5 is a graph illustrating a lift state of a valve.

A description will next be given of a lift state of the valve V. FIG. 5 is a graph illustrating a lift state of the valve V. The vertical axis represents a lift amount, and the horizontal axis represents a crank angle. A lift curve HC indicates a lift amount of the valve V in the locked state, and a lift curve LC indicates a lift amount of the valve V in the released state. Therefore, the lift curve HC indicates a lift amount of the valve V by the cam lobe portion 20, and the lift curve LC indicates a lift amount of the valve V by the nose portion 11*n* of the cam base portion 10.

As illustrated in FIG. 5, the lift curves LC and HC do not coincide with each other in a part before the lift amount reaches a maximum, but substantially coincide with each other in a latter part. This is because the inclined surface 23 of the cam lobe portion 20 partially substantially coincides with the outer peripheral surface of the nose portion 11*n* of the cam base portion 10 as viewed from the axial direction when the cam lobe portion 20 is either at the high position or at the low position as illustrated in FIGS. 2A and 2B.

The crank angles are approximately the same when the lift amount returns to zero in both the lift curves HC and LC. This is because the boundary part on the outer peripheral surface between the nose portion 11*n* of the cam base portion 10 located at the inclined surface 23 side and the base circular portion 11 substantially coincides with the part where the inclined surface 23 of the cam lobe portion 20 intersects the outer peripheral surface of the base circular portion 11 as viewed from the axial direction when the cam lobe portion 20 is either at the high position or at the low position. The inclined surface 21 is an example of a first inclined surface that protrudes from the outer peripheral surface of the first cam portion in the first state. The inclined surface 23 is an example of a second inclined surface that partially coincides with the outer peripheral surface of the first cam portion both in the first and second states as viewed from the axial direction of the camshaft.

In the released state, the inclined surface 21 of the cam lobe portion 20 is first pressed by the rocker arm R, and the cam lobe portion 20 swings from the high position to the low position. Then, while the inclined surface 23 beyond the top surface 22 of the cam lobe portion 20 is pressed by the rocker arm R, the cam lobe portion 20 swings from the low position to the high position while rotating so as to separate from the rocker arm R. At this time, the nose portion 11*n* of the cam base portion 10 also contacts with the rocker arm R. That is to say, both the cam base portion 10 and the cam lobe portion 20 rotate while contacting with the rocker arm R, and the cam lobe portion 20 swings from the low position to the high position. This is because the inclined surface 23 of the cam lobe portion 20 partially coincides with the outer peripheral surface of the nose portion 11*n* of the cam base portion 10 as viewed from the axial direction while the cam lobe portion 20 swings between the high position and the low position, as described previously.

Therefore, in the released state, while the cam lobe portion 20 recovers from the low position to the high position, the cam lobe portion 20 swings while contacting with the rocker arm R and receiving the reactive force. Thus, the time for the cam lobe portion 20 to recover from the low position to the high position can be secured, and the speed of the swing of the cam lobe portion 20 during the time for the cam lobe portion 20 to recover from the low position to the high position can be reduced. Accordingly, a hitting sound generated by the contact between the stopper pin 34P and the end portion of the elongated hole 14 at the time when the cam lobe portion 20 recovers to the high position can be reduced. In addition, the impact applied to the stopper pin 34P contacting the end portion of the elongated hole 14 at the time when the cam lobe portion 20 recovers to the high position can be reduced. Accordingly, the stopper pin 34P is not required to be thick beyond necessity to secure its rigidity.

Figure 6:
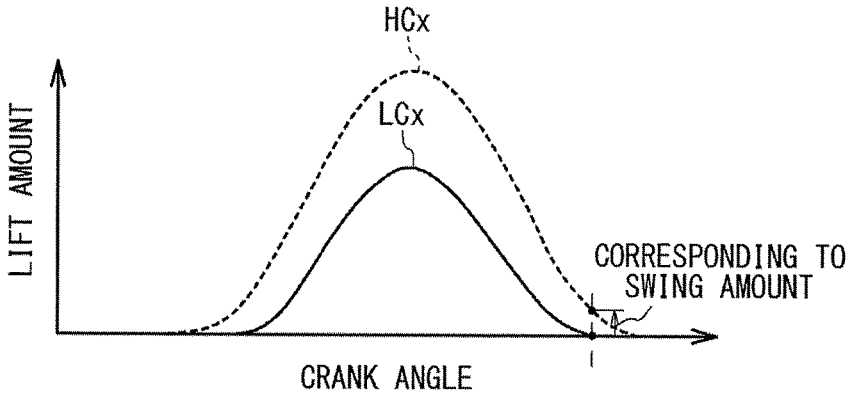
FIG. 6 is a graph illustrating a lift state of a valve of a comparative example.

FIG. 6 is a graph illustrating a lift state of a valve of the comparative example. For example, assume a case where the cam lobe portion 20 recovers from the low position to the high position in a state where the cam lobe portion 20 separates from the rocker arm R and the reactive force from the rocker arm R does not act on the cam lobe portion 20. Here, the timing at which the valve V closes on the lift curve LCx corresponds to the timing at which the cam lobe portion 20 separates from the rocker arm R. In addition, the lift amount of the valve V on the lift curve HCx at this timing corresponds to the swing amount of the cam lobe portion 20 from the time the cam lobe portion 20 separates from the rocker arm R till it recovers to the high position. When the swing amount between the position of the cam lobe portion 20 when the cam lobe portion 20 separates from the rocker arm R and the high position is large, the hitting sound at the time of recovery to the high position may increase because the cam lobe portion 20 accelerates according to the biasing force of the spring 34*s* during the swing. The present embodiment can reduce the hitting sound compared to the comparative example because the cam lobe portion 20 recovers from the low position to the high position while receiving the reactive force of the rocker arm R as described above.

Figure 7A:
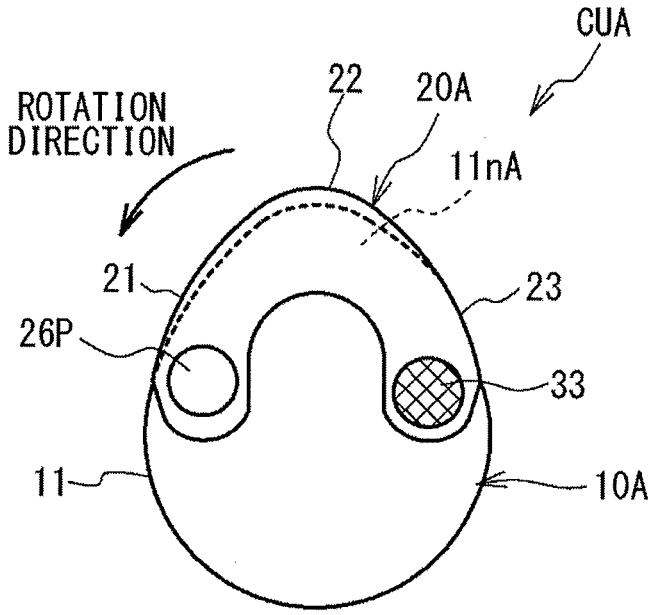
FIGS. 7A and 7B are explanatory diagrams of a cam unit of a first variation.
Figure 7B:
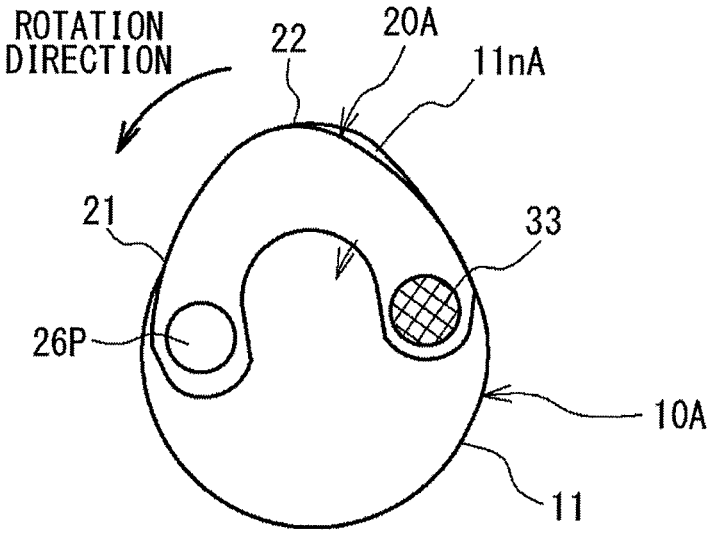

FIGS. 7A and 7B are explanatory diagrams of a cam unit CUA of a first variation. Similar reference numerals are affixed to the components similar to those in the aforementioned embodiment, and the redundant description is omitted. FIGS. 7A and 7B omit the illustration of the camshaft S, the coupling pin CP, the stopper pin 34P, and the elongated hole 14. The pin 26P is located on the leading side relative to the rotation direction of the camshaft S, and located at the inclined surface 21 side. The support shaft 33 is located on the trailing side relative to the rotation direction, and is located at the inclined surface 23 side. The inclined surface 23 partially coincides with the outer peripheral surface of a nose portion 11*n*A. More specifically, when a cam lobe portion 20A is either at the high position or at the low position, the inclined surface 23 of the cam lobe portion 20A partially substantially coincides with the outer peripheral surface of the nose portion 11*n*A of a cam base portion 10A as viewed from the axial direction. The inclined surface 21 is an example of an inclined surface that acts on the rocker arm R so that the valve V is opened by the rotation of the cam lobe portion 20A and is located at a valve opening side. The inclined surface 23 is an example of an inclined surface that acts on the rocker arm R so that the valve V is closed by the rotation of the cam lobe portion 20A and is located at a valve closing side.

Accordingly, in the released state, the cam lobe portion 20A swings from the low position to the high position while the cam base portion 10A and the cam lobe portion 20A contact with the rocker arm R in accordance with the rotation of the camshaft S. Thus, as with the graph illustrated in FIG. 5, the lift curves coincide with each other in a latter part in the released state and in the locked state. Therefore, the hitting sound at the time when the cam lobe portion 20A recovers to the high position can be reduced.

Figure 8A:
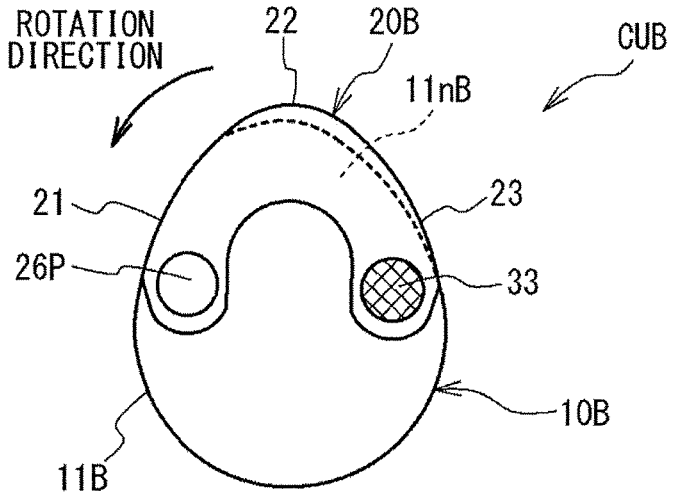
FIGS. 8A and 8B are explanatory diagram of a cam unit of a second variation.
Figure 8B:
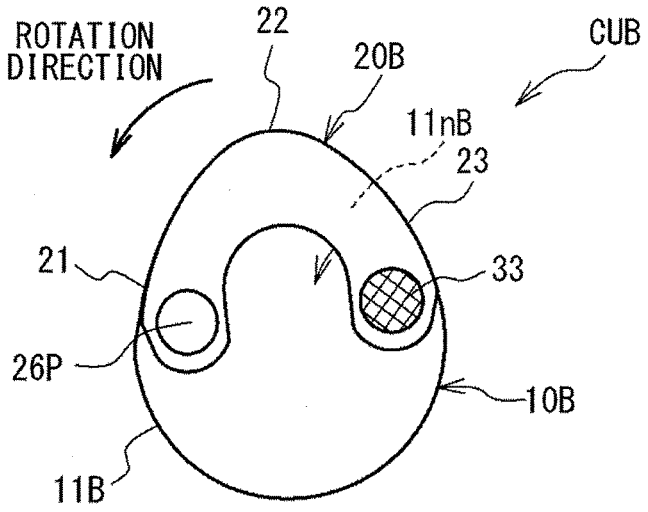

FIGS. 8A and 8B are explanatory diagrams of a cam unit CUB of a second variation. FIG. 8A illustrates a case where a cam lobe portion 20B is at the high position, and FIG. 8B illustrates a case where the cam lobe portion 20B is at the low position. The pin 26P is located on the leading side relative to the rotation direction of the camshaft S. The support shaft 33 is located on the trailing side relative to the rotation direction. The inclined surface 21 of the cam lobe portion 20B partially coincides with the outer peripheral surface of a nose portion 11*n*B as viewed from the axial direction also when the cam lobe portion 20B is either at the high position or at the low position. However, when the cam lobe portion 20B is at the high position, the top surface 22 and the inclined surface 23 of the cam lobe portion 20B protrude further out than the nose portion 11*n*B, and the outer peripheral surface of the inclined surface 23 of the cam lobe portion 20B does not coincide with the outer peripheral surface of the nose portion 11*n*B. The inclined surface 21 is an example of an inclined surface that acts on the rocker arm R so that the valve V is opened by the rotation of the cam lobe portion 20B and is located at the valve opening side. The inclined surface 23 is an example of an inclined surface that acts on the rocker arm R so that the valve V is closed by the rotation of the cam lobe portion 20B and is located at the valve closing side.

Figure 9:
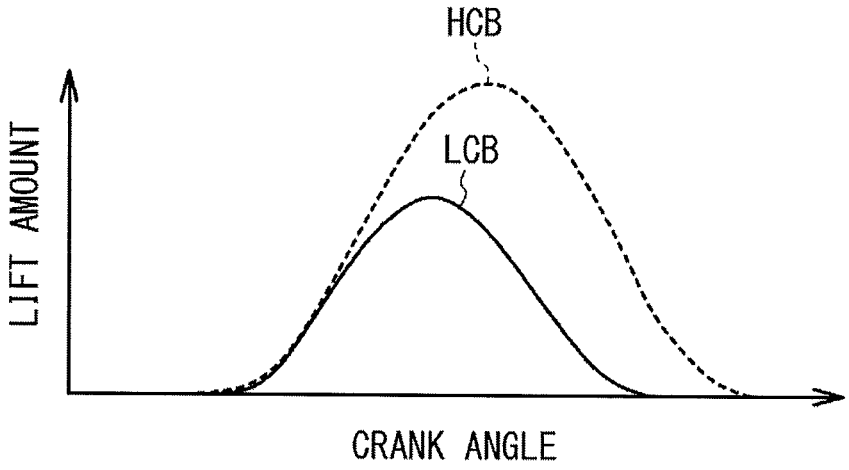
FIG. 9 is a graph illustrating a lift state of a valve by the cam unit of the second variation.

FIG. 9 is a graph illustrating a lift state of the valve V by the cam unit CUB of the second variation. The lift curves LCB and HCB substantially coincide with each other in a part before the lift amount reaches a maximum, but do not coincide with each other in a latter part.

Figure 10A:
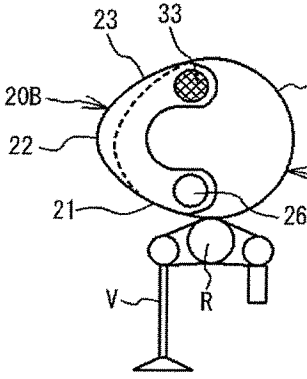
FIGS. 10A through 10D illustrate rotational states of the cam unit of the second variation.
Figure 10B:
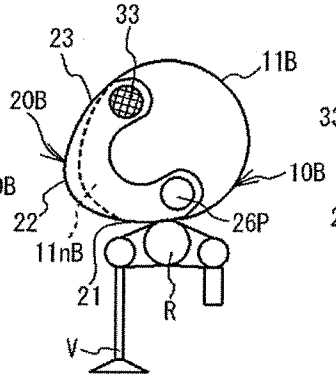
Figure 10C:
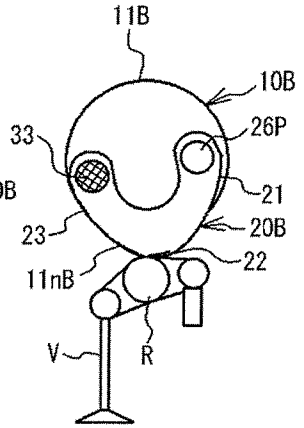
Figure 10D:
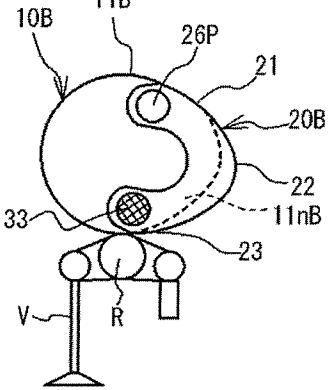
Figure 10E:
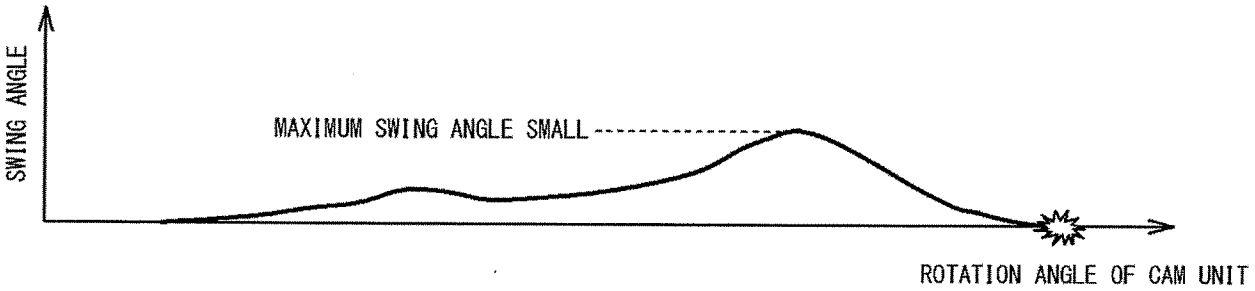
FIG. 10E is a graph illustrating a swing angle of a cam lobe portion of the cam unit of the second variation.

FIGS. 10A through 10D are diagrams illustrating rotational states of the cam unit CUB of the second variation. FIG. 10E is a graph illustrating a swing angle of the cam lobe portion 20B of the cam unit CUB of the second variation. In FIG. 10E, the vertical axis represents the swing angle of the cam lobe portion 20B, and the horizontal axis represents the rotation angle of the cam unit CUB. The swing angle in a state where the cam lobe portion 20B is at the high position is assumed to be 0 degree.

Figure 11:
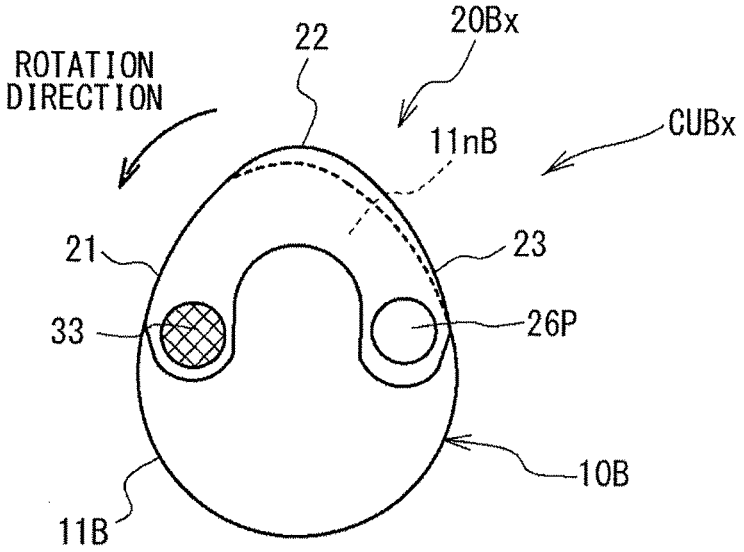
FIG. 11 is an explanatory diagram of a cam unit of a comparative example.

FIG. 11 is an explanatory diagram of a cam unit CUBx of a comparative example. Unlike the cam unit CUB, in the cam unit CUBx, the support shaft 33 is located on the leading side relative to the rotation direction, and the pin 26P is located on the trailing side relative to the rotation direction. The lift curves by the cam unit CUBx also substantially coincide with each other in the released state and the locked state in a first half, but do not coincide with each other in a latter part as with in the graph illustrated in FIG. 9.

Figure 12A:
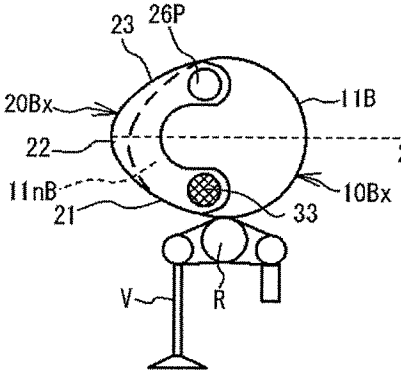
FIGS. 12A through 12D illustrate rotational states of the cam unit of the comparative example.
Figure 12B:
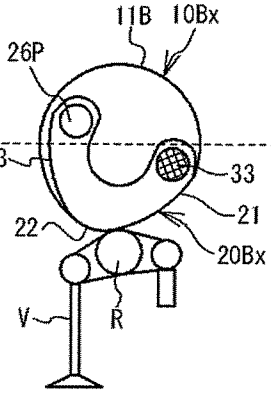
Figure 12C:
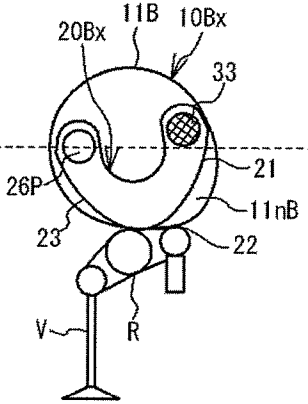
Figure 12D:
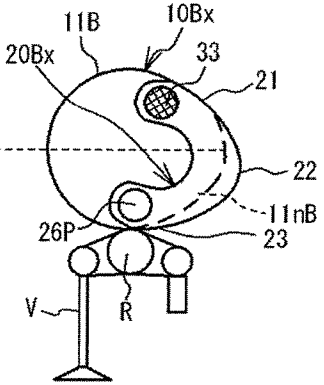
Figure 12E:
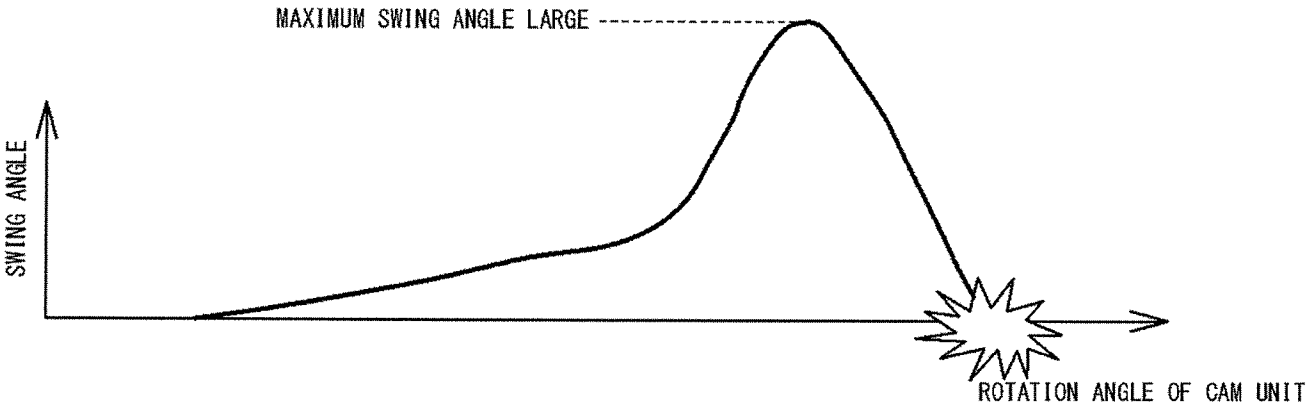
FIG. 12E is a graph illustrating a swing angle of a cam lobe portion of the cam unit of the comparative example.

FIGS. 12A through 12D are diagrams illustrating rotational states of the cam unit CUBx of the comparative example. FIG. 12E is a graph illustrating a swing angle of a cam lobe portion 20Bx of the cam unit CUBx of the comparative example. In FIG. 12E, the vertical axis represents the swing angle of the cam lobe portion 20Bx, and the horizontal axis represents the rotation angle of the cam unit CUB. The swing angle in a state where the cam lobe portion 20Bx is at the high position is assumed to be 0 degree.

As illustrated in FIGS. 10E and 12E, the maximum swing angle of the cam lobe portion 20B is less than that of the cam lobe portion 20Bx in the released state. For example, the swing angle in a case where the support shaft 33 is located on the trailing side relative to the rotation direction of the camshaft S as illustrated in FIG. 10C is less than the swing angle in a case where the support shaft 33 is located in the rotation direction of the camshaft S as illustrated in FIG. 12C. This is because the cam lobe portion 20B gradually recovers from the low position to the high position while the rocker arm R contacts with the latter part of the nose portion 11*n*B whereas the cam lobe portion 20Bx is further pressed toward the low position by the rocker arm R even while the rocker arm R contacts with the latter part of the nose portion 11*n*B.

In addition, each of the cam lobe portions 20B and 20Bx separates from the rocker arm R and recovers to the high position after the swing angle reaches a maximum. Thus, the swing amount of the cam lobe portion 20B when the swing angle recovers from the maximum position to the high position is less than that of the cam lobe portion 20Bx. In addition, the rotation angle of the camshaft S of the cam lobe portion 20B required for the swing angle to recover from the maximum position to the high position is greater than that of the cam lobe portion 20Bx. Thus, the swing angle of the cam lobe portion 20B gently recovers from the maximum position to the high position whereas the swing angle of the cam lobe portion 20Bx rapidly recovers from the maximum position to the high position. Accordingly, the cam lobe portion 20B reduces the hitting sound at the time of recovery to the high position compared to the cam lobe portion 20Bx.

Figure 13:
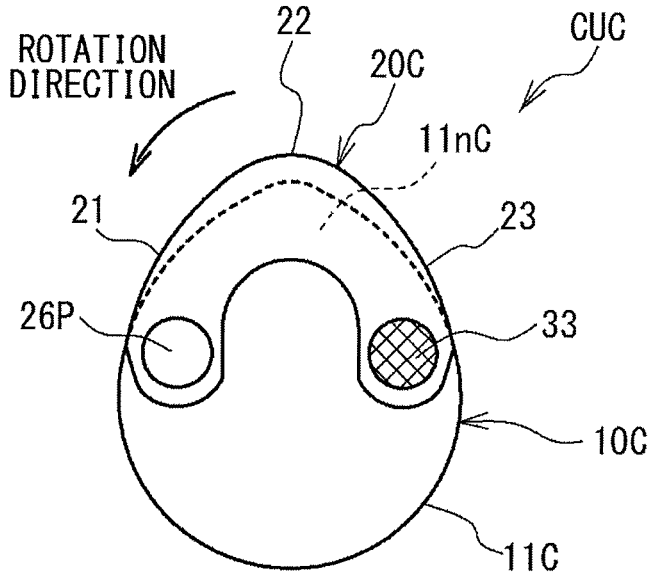
FIG. 13 is an explanatory diagram of a cam unit of a third variation.
Figure 14:
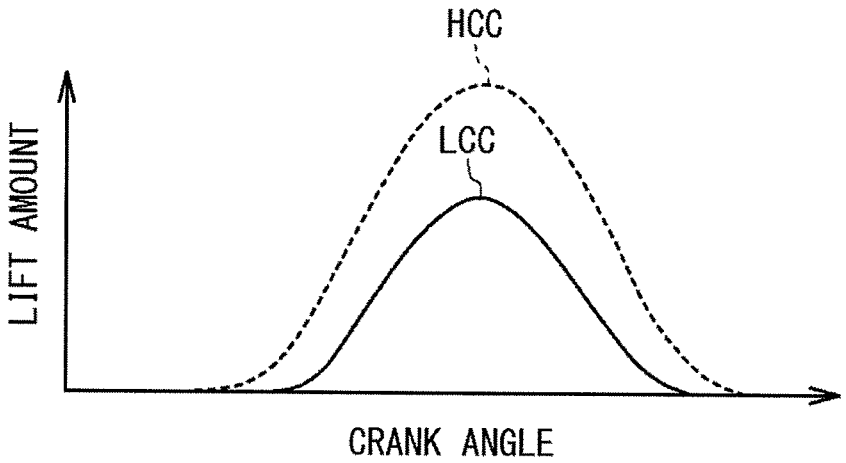
FIG. 14 is a graph illustrating a lift state of a valve by the cam unit of the third variation.

FIG. 13 is an explanatory diagram of a cam unit CUC of a third variation. FIG. 13 illustrate a case where a cam lobe portion 20C is at the high position. In the cam unit CUC, the pin 26P is located on the leading side relative to the rotation direction of the camshaft S, and the support shaft 33 is located on the trailing side relative to the rotation direction. When the cam lobe portion 20C is at the high position, the inclined surface 21, the top surface 22, and the inclined surface 23 of the cam lobe portion 20C protrude from the outer peripheral surface of a nose portion 11*n*C as viewed from the axial direction. FIG. 14 is a graph illustrating a lift state of the valve V by the cam unit CUC of the third variation. The lift curves LCC and HCB never coincide with each other in any part. The inclined surface 21 is an example of an inclined surface that acts on the rocker arm R so that the valve V is opened by the rotation of the cam lobe portion 20C and is located at the valve opening side. The inclined surface 23 is an example of an inclined surface that acts on the rocker arm R so that the valve V is closed by the rotation of the cam lobe portion 20C and is located at the valve closing side.

Figure 15:
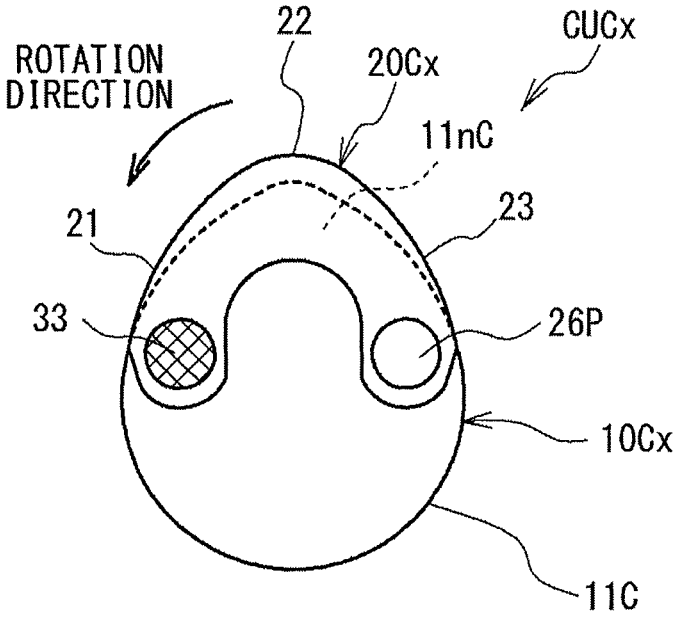
FIG. 15 is an explanatory diagram of a cam unit of a comparative example.

FIG. 15 is an explanatory diagram of a cam unit CUCx of a comparative example. Unlike the cam unit CUC, in the cam unit CUCx, the support shaft 33 is located on the leading side relative to the rotation direction, and the pin 26P is located on the trailing side relative to the rotation direction. The lift curves by the cam unit CUCx never coincide with each other in any part in the released state or in the locked state as with in the graph illustrated in FIG. 14.

Also in this case, the swing amount of the cam lobe portion 20C is less than that of a cam lobe portion 20Cx. The rotation angle of the camshaft S of the cam lobe portion 20C required for the swing angle to recover from the maximum position to the high position is greater than that of the cam lobe portion 20Cx. Thus, the cam lobe portion 20C gently swings to the high position, whereas the cam lobe portion 20Cx rapidly swings to the high position. Accordingly, the cam lobe portion 20C reduces the hitting sound at the time of recovery to the high position compared to the cam lobe portion 20Cx.

While the exemplary embodiments of the present invention have been illustrated in detail, the present invention is not limited to the above-mentioned embodiments, and other embodiments and various variations may be made without departing from the scope of the present invention.

In the present embodiment, the cam base portion 10 is composed of the cam piece portions 10*a* through 10*c*, but the cam piece portions 10*a* through 10*c* may be integrally formed. For example, a slit capable of accommodating the cam lobe portion may be formed in a single cam base portion. Moreover, in the present embodiment, the cam base portion 10 is formed separately from the camshaft S, but may be integrally formed. A hole penetrated by the camshaft S may not be formed in the cam base portion 10, and a shaft member may be coupled to both end portions of the cam base portion 10 in the axial direction to use the shaft member as a camshaft.

In the present embodiment, two cam lobe portions 20 are swingably supported in relation to the cam base portion 10, but at least one of the cam lobe portions 20 is required to be swingable. Alternatively, a swingable single cam lobe portion may be coupled to the cam base portion, and one of two rocker arms may be driven by the cam base portion and the cam lobe portion, and the other rocker arm may be driven by a normal cam.

In the cam unit CU of FIGS. 2A and 2B, the cam base portion 10 includes the nose portion 11*n*, but this does not intend to suggest any limitation. For example, the cam base portion 10 may not include a nose portion and has a circular shape including a base circular portion, and the cam lobe portion 20 may swing between a high position where the cam lobe portion 20 protrudes from the cam base portion 10 and a low position that is located lower than the high position and where the cam lobe portion 20 protrudes from the cam base portion 10. Even in this case, when the cam lobe portion 20 is either at the high position or at the low position, the inclined surface 23 of the cam lobe portion 20 is required to partially substantially coincide with the outer peripheral surface of the cam base portion 10 as viewed from the axial direction. In accordance with the rotation of the camshaft, the cam lobe portion 20 is required to swing from the low position to the high position while the cam base portion 10 and the cam lobe portion 20 contact with the cam follower. The same applies to the cam unit CUA of FIGS. 7A and 7B.

When the internal combustion engine equipped with the adjustable valve device 1 of the present embodiment operates at the minimum rotation speed, the cam lobe portion 20 is required to recover from the low position to the high position while contacting with the rocker arm R in the released state and receiving the reactive force from the rocker arm R.

In the cam unit CUB of FIGS. 8A and 8B, a cam base portion 10B has the nose portion 11*n*B, but this does not intend to suggest any limitation. For example, the cam base portion 10B may not have a nose portion, and may have a cylindrical shape including a base circular portion, and the cam lobe portion 20B may swing between a high position where the cam lobe portion 20B protrudes from the cam base portion 10B and a low position that is located lower than the high position and where the cam lobe portion 20B protrudes from the cam base portion 10B. Alternatively, the cam lobe portion 20B may swing between a high position where the cam lobe portion 20B protrudes from the cam base portion 10B and a low position where the cam lobe portion 20B does not protrude from the cam base portion 10B. Also in this case, the structure designed to have the support shaft 33 located on the trailing side relative to the rotation direction of the camshaft S can reduce the maximum swing angle of the cam lobe portion 20 and the hitting sound compared to the structure designed to have the support shaft 33 located in the rotation direction of the camshaft S. The same applies to the cam unit CUC of FIG. 13.

The cam lobe portion 20 is swingably supported by the support shaft 33 that penetrates through the cam lobe portion 20 and the cam base portion 10, but this structure does not intend to suggest any limitation. For example, the cam lobe portion 20 may be swingably coupled around a shaft portion integrally formed in the cam base portion 10. Alternatively, a shaft portion may be integrally formed in the cam lobe portion 20, and a recess portion that rotatably accommodates the shaft portion may be formed in the cam base portion 10.

The first end of the spring 34*s* may be fixed to the cam base portion 10, and the second end may be fixed to the cam lobe portion 20.

DESCRIPTION OF LETTERS OR NUMERALS

1 variable valve device
5 ECU
S camshaft
R rocker arm
V valve
OCV oil control valve
10 cam base portion (first cam portion)
11 base circular portion
11*n* nose portion
12 space
16S spring (lock member biasing member)
17 hole (first engagement hole)
17P pin (pressing member)
20 cam lobe portion (second cam portion)
21 inclined surface (first inclined surface)
22 top surface
23 inclined surface (second inclined surface)
26 hole (second engagement hole)
26P pin (lock member)
27 engagement recess portion (engagement portion)
33 support shaft
34*s* spring (biasing member)
T, T6 passage

The invention claimed is:

1. An adjustable valve device of an internal combustion engine comprising:

a first cam portion that is penetrated by a camshaft, rotates together with the camshaft, and includes an elongated hole formed therein;

a second cam portion that is formed into a U-shape or a L-shape, and is supported by the first cam portion so as to swing to move between a first state where the second cam portion is located at a position where the second cam portion protrudes from an outer peripheral surface of the first cam portion and a second state where the second cam portion is located at a position lower than a position in the first state;

a stopper pin that is fixed to the second cam portion and penetrates through the elongated hole;

a biasing member that intervenes between the first cam portion and the second cam portion, and biases the stopper pin so that the second cam portion becomes in the first state;

a lock mechanism that locks the second cam portion only when the second cam portion is in the first state; and a cam follower that exerts a reactive force on the second cam portion so that the second cam portion becomes in the second state in a state where a lock of the second cam portion is released, wherein the reactive force is greater than a biasing force of the biasing member.

2. The adjustable valve device of an internal combustion engine according to claim 1, wherein the lock mechanism includes:

a first engagement hole that is formed in the first cam portion;

a second engagement hole that is formed in the second cam portion, and faces the first engagement hole in the first state;

a pressing member that is accommodated in the first engagement hole;

a lock member that is accommodated in the second engagement hole;

a lock member biasing member that biases the lock member so that the lock member engages with the first and second engagement holes in the first state; and a passage that communicates with the first engagement hole, and exerts hydraulic pressure on the pressing member so that the lock member is disconnected from the first engagement hole against a biasing force of the lock member biasing member in the first state.

3. The adjustable valve device of an internal combustion engine according to claim 2, wherein the first and second engagement holes extend in an axial direction of the camshaft.

4. The adjustable valve device of an internal combustion engine according to claim 1, wherein the second cam portion includes:

a first inclined surface that protrudes from an outer peripheral surface of the first cam portion in the first state; and a second inclined surface that partially coincides with the outer peripheral surface of the first cam portion as viewed from an axial direction of the camshaft in either of the first and second states.

5. The adjustable valve device of an internal combustion engine according to claim 1, wherein the second cam portion moves from the second state to the first state while the first and second cam portions contact with the cam follower in accordance with rotation of the camshaft in the state where the lock of the second cam portion is released.

6. The adjustable valve device of an internal combustion engine according to claim 1, wherein the second cam portion includes:

an inclined surface located at a valve opening side of the second cam portion; and an inclined surface located at a valve closing side of the second cam portion, and a fulcrum point of swing of the second cam portion is located at a side of the inclined surface located at the valve closing side of the second cam portion.

* * * * *